United States Patent [19]

Parsons

[11] Patent Number: 4,970,995

[45] Date of Patent: Nov. 20, 1990

[54] INTERNAL COMBUSTION ENGINES

[75] Inventor: Bryan N. V. Parsons, Stoney Stanton, United Kingdom

[73] Assignee: Jaguar Cars Limited, United Kingdom

[21] Appl. No.: 478,260

[22] Filed: Feb. 9, 1990

[30] Foreign Application Priority Data

Feb. 10, 1989 [GB] United Kingdom ..... 8904058

[51] Int. Cl.[5] ..... F02B 75/32

[52] U.S. Cl. ..... 123/55 R; 123/197 R

[58] Field of Search ..... 123/197 R, 197 AB, 197 AC, 123/55 R, 55 A, 55 SR, 5 ZA

[56] References Cited

U.S. PATENT DOCUMENTS

| | | | |
|---|---|---|---|
| 1,326,863 | 12/1919 | Heinkel | 74/63 |
| 1,378,191 | 5/1921 | Pale | 74/63 |
| 2,337,330 | 12/1943 | Julin | 123/197 AC |
| 2,522,735 | 9/1950 | Zagar | 74/63 |
| 3,606,870 | 9/1971 | Llewellyn | 123/55 R |
| 3,886,805 | 6/1975 | Koderman | 123/197 AC |
| 3,946,706 | 3/1976 | Pailler | 123/197 AB |
| 4,328,715 | 5/1982 | Gorkov | 74/674 |
| 4,614,169 | 9/1986 | Figliuzzi | 123/197 AC |
| 4,674,361 | 6/1987 | Parsons | 74/674 |
| 4,682,569 | 7/1987 | Stiller et al. | 123/197 AC |

FOREIGN PATENT DOCUMENTS

| | | | |
|---|---|---|---|
| 12838/76 | 11/1978 | Australia . | |
| 2318760 | 12/1973 | Fed. Rep. of Germany . | |
| 3447663 | 7/1986 | Fed. Rep. of Germany | 123/197 AC |
| 534186 | 1/1922 | France | 123/90.31 |
| 0212301 | 12/1982 | Japan | 123/197 AB |
| 2160612A | 12/1985 | United Kingdom . | |

*Primary Examiner*—David A. Okonsky

*Attorney, Agent, or Firm*—Davis, Bujold & Streck

[57] ABSTRACT

An internal combustion engine includes a piston slidingly sealed and constrained to move along a linear path in a cylinder, the piston having a rigid connecting rod which extends axially of the cylinder, a link constrained to move in an orbital path in a plane parallel to the axis of the cylinder is coupled to the connecting rod by means of a crank shaft rotatably mounted on the link, the crank shaft having a first crank pin which is pivotally connected to the connecting rod, the first crank pin being constrained to move in a linear path as the link moves about its orbital path and the crank shaft rotates relative to the link, so that linear movement of the piston will drive the link about its orbital path, a drive shaft being coupled to the link so that orbital movement of the link will cause the drive shaft to rotate.

25 Claims, 3 Drawing Sheets

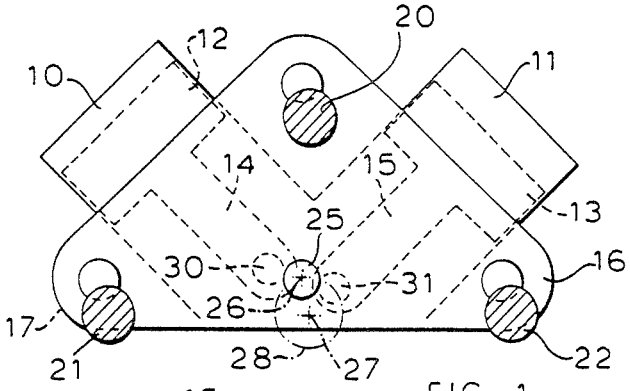
FIG 1
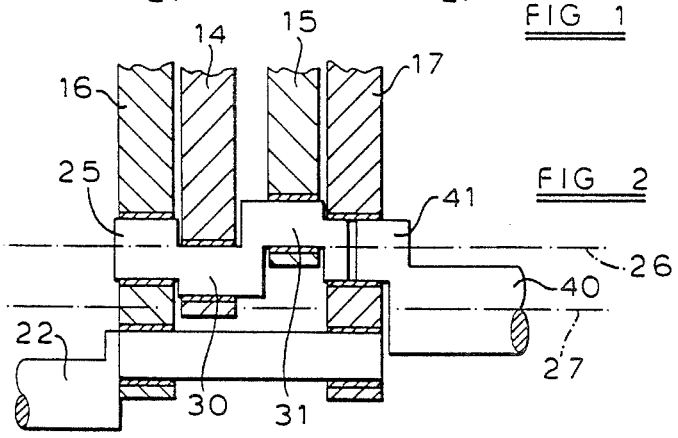
FIG 2
FIG 3
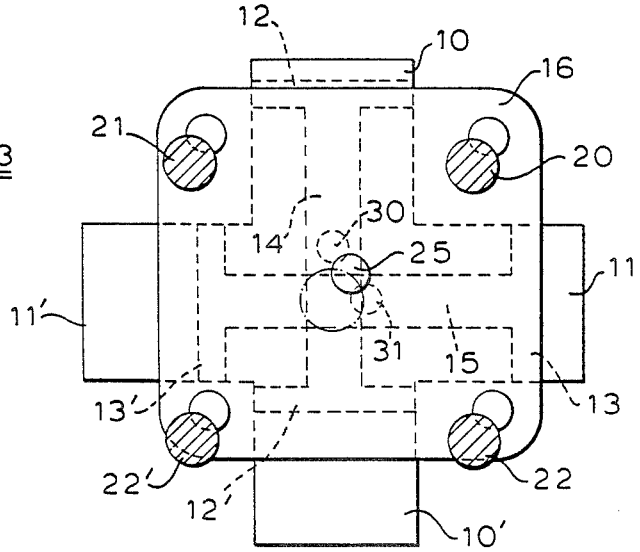

INTERNAL COMBUSTION ENGINES

BACKGROUND TO THE INVENTION

The present invention relates to internal combustion engines.

SUMMARY OF THE INVENTION

According to one aspect of the present invention an internal combustion engine comprises a piston slidingly sealed and constrained to move along a linear path in a cylinder, the piston having a rigid connecting rod which extends axially of the cylinder, a link constrained to move in an orbital path in a plain parallel to the axis of the cylinder, the link being coupled to the connecting rod by means of a crank shaft rotatedly mounted on the link, said crank shaft having a first crank pin which is pivotally connected to the connecting rod and means which will constrain said first crank pin to move in a linear path coaxial of the cylinder, so that linear motion of the piston will drive the link about its orbital path, an output shaft being coupled to the link so that orbital motion of the link will rotate the output shaft.

According to a preferred embodiment the crank shaft has a second crank pin, said second crank pin being pivotally connected to means which will constrain said second crank pin to move in a linear path, the axis of said linear path being parallel to the plane of the orbital path of the link and transverse to the axis of the connecting rod, so that the first crank pin will be constrained thereby to move in a linear path coaxially of the cylinder. The link may be made up of a pair of spaced plates, the crank being rotatably supported across the plates with the crank pins located therebetween. Alternatively, a single crank pin may be disposed between the plates, two further crank pins being disposed one on either side of the link.

The means which constrain said second crank pin to move in a linear path may be a piston, linearly sliding guide or a hypocycloidal gear mechanism. For balancing purposes, it is advantageous to use a second piston or linearly guided weight, the reciprocating motion of the pistons or piston and weight giving a resultant rotary oscillation which can be balanced by counter rotating balance weights in conventional manner.

In its simplest form, the engine may be configured as a single cylinder two stroke engine. With this configuration, flywheel means will be necessary to move the piston on its return stroke. A conventional flywheel on the output shaft may be used for this purpose. The inertia of the link or weights which provide guidance for the second crank may alternatively be used to return the piston. Several such single cylinder assemblies may be combined into a multi-cylinder, two or four stroke engine with appropriate phase relationship between the cylinders.

Alternatively, a second piston may be used to constrain the second crank pin thereby providing a two cylinder V-configuration. With this arrangement, the pistons will be 90 degrees out of phase so that power may be applied over 270 degrees of the operating cycle. In its two cylinder configuration, the inertia of the fly wheel or the components of the system will thus be required to complete the return stroke of the piston. Again, several double piston assemblies of this form may be combined to form a mutli-cylinder, two or four stroke engine.

In order to obtain more uniform power distribution, the cylinder/pistons may be arranged in opposed pairs, the opposed pistons being interconnected by rigid connecting rods, so that each piston will move under power in both directions.

Generally, the engine according to the present invention utilizes a double crank and the direction of movement of the first crank pin will be perpendicular to the direction of the movement of the second crank pin. However, the crank shaft may have additional crank pins, preferably arranged symmetrically, so that for example three or more opposed pairs of pistons may be disposed radially.

The link may be constrained for orbital motion by means of a plurality of idler cranks which are of equal throw to the cranks of the crank shaft. Other means, for example an Oldham coupling, may however be used for this purpose.

The output shaft may be coupled to the link my means of a crank, gear mechanism or pin drive mechanism, for example as described in UK Pat. No. 2160612B or UK patent application Ser. No. 8826212. Furthermore, other drives, for example cam shaft drives, rotary valve drives, starter motor input drives or drives for ancillary equivalent, may be coupled to the link, in similar manner. Various embodiments of the invention are now described, by way of example only, with reference to the accompanying drawings, in which;

BRIEF DESCRIPTION OF THE DRAWINGS

FIG. 1 is a diagram illustrating in side elevation a two cylinder engine formed in accordance with the present invention;

FIG. 2 is a part sectional end elevation of the engine illustrated in FIG. 1;

FIG. 3 is a diagram illustrating in side elevation a four cylinder modification of the engine illustrated in FIG. 1;

DESCRIPTION OF A PREFERRED EMBODIMENT

Figure 4:
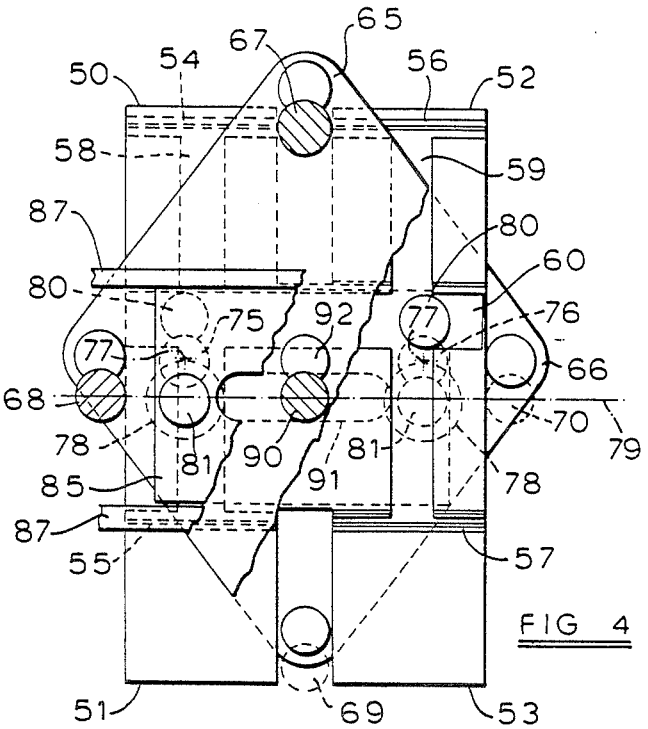
FIG. 4 is a diagram illustrating in side elevation a four cylinder engine of alternative configuration.

In the engine illustrated in FIGS. 1 and 2, two cylinders 10 and 11 are disposed at right angles to one another the axis of cylinder 10 being spaced laterally of that of the cylinder 11. Pistons 12 and 13 are slidingly sealed in each of the cylinders 10 and 11, the pistons 12 and 13 being of sufficient depth to maintain them coaxial with the cylinders 10 and 11, each piston having a rigid connecting rod 14, 15 which extends axially of the associated cylinder 10, 11.

A pair of plates 16, 17 are disposed one on either side of the cylinders 10 and 11 the planes of the plates 16 and 17 being parallel to the axes of the cylinders 10 and 11. The plates 16 and 17 are mounted on idler cranks 20, 21, 22 all of which are disposed at the same angular position relative to their axes of rotation. These idler cranks 20, 21, 22 constrain the plates 16, 17 to move about an orbital path. The plates 16 and 17 are interconnected by suitable means which span the gap between the plates 16 and 17 at positions which will not foul the engine block, as the plates 16 and 17 move about their orbital path. This may be achieved, for example, by bolting the plates 16 and 17 together or by extending the idler cranks 20, 21 and 22 so they interconnect the plates 16 and 17.

A crank shaft 25 is rotatedly mounted in suitable bearings between the plates 16 and 17, the axis 26 of the crank shaft 25 being disposed parallel to the line of intersection 27 of the axial planes of connecting rods 14 and 15 which are normal to the plates 16 and 17, and is spaced at a distance therefrom equal to the throw of the idler cranks 20, 21 and 22, the angular relationship of axis 26 to line of intersection 27 corresponding to that of the idler cranks 20, 21 and 22 to their axes of rotation.

The crank shaft 25 has a pair of crank pins 30, 31 disposed diametrically opposite to one another and having a throw equal to the throw of the idler cranks 20, 21 and 22. Crank pin 30 is pivotally connected, by means of a suitable bearing, to the connecting rod 14 and the crank pin 31 is pivotally connected by means of a suitable bearing to the connecting rod 15.

An output shaft 40 the axis of rotation of which is normal to the plain of movement of the plates 16 and 17, is coupled to the plate 16 by means of a crank 41. The output shaft 40 may be positioned on an axis which coincides with the line of intersection 27 of the axial planes of connecting rods 14 and 15 or at any other position, for example the output shaft may alternatively take the place of one of the idler cranks 20, 21 or 22.

As illustrated in FIG. 1, the piston 12 is just past top-dead-centre and will be moving downwardly on its power stroke. Downward movement of the piston 12 will cause the crank pin 30 to move along the axis of connecting rod 14, thus causing the crank shaft 25 to move about the circular path 28 and causing the plates 16 and 17 to move about their orbital paths. As crank pin 30 moves downwardly, the crank 25 is rotated so that crank pin 31 moves to the right, until when the axis of crank pin 30 coincides with the line of intersection 27, the piston 13 will be at top-dead-centre. Upon firing of cylinder 11, both pistons will be on their power stroke, causing crank pin 30 to continue its downward movement and crank pin 31 to move to the left. When the axis of crank pin 31 coincides with the line of intersection 27, the crank pin 30 will have reached the limit of its downward movement and the piston 12 will then be at bottom-dead-centre. Piston 13 continues to move the crank 31 to the left still applying power, as the piston 12 begins its return stroke. This continues until the piston 13 reaches bottom-dead-centre when the inertia of the plates 16 and 17 will continue the return movement of the pistons 12 and 13, until piston 12 is again at top-dead-centre and firing of cylinder 10 will begin a new power stroke. The engine described above will consequently be under power for 270 degrees of its operating cycle.

The orbital motion of the plates 16 and 17 produced in this manner drives the output shaft 40 by crank 41. A fly wheel may be provided on the output shaft 40 in order to assist in moving the pistons on their return stroke, during the non-power portion of the operating cycle. Alternatively, two or more two cylinder assemblies, suitably phased, may be arranged to drive the output shaft 40, to provide a continuous power output.

In the modification illustrated in FIG. 3, two additional cylinders 10' and 11' are provided, cylinder 10' being opposed axially to cylinder 10 and cylinder 11' being opposed axially to cylinder 11. Pistons 12' and 13' are slidingly sealed in cylinders 10' and 11' respectively and the connecting rods 14 and 15 are extended so that the pistons 12 and 12' and 13 and 13' respectively are rigidly interconnected. With this embodiment, the depth of the pistons 12, 12', 13 and 13' may be reduced as one piston 12, 13 will constrain the interconnected piston 12', 13' to move coaxially of the cylinders 10, 10', 11, 11', and vice versa.

With this arrangement, for two stroke operation the cylinders 10, 11, 10' and 11' will be fired sequentially so that the pistons will move in both directions under power giving a uniform power output distribution. This configuration could also be used for four stroke operation.

The balanced arrangement of pistons 10, 11, 10', 11' in this configuration will produce a rotary vibration about the line of intersection 27. This vibration may be balanced by rotating weights associated with the output shaft 40 or idler cranks 20, 21, 22, 22'.

Figure 5:
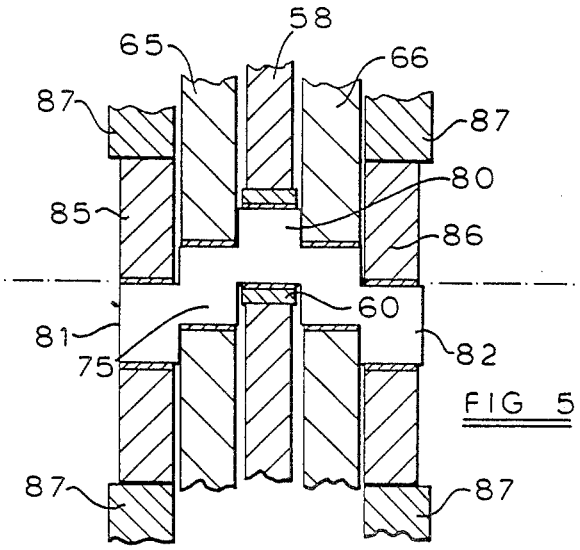
FIG. 5 is a part sectional end elevation of the engine illustrated in FIG. 4.

In the engine illustrated in FIGS. 4 and 5, two pairs of opposed cylinders 50 and 51, and 52 and 53 are arranged side by side. Pistons 54, 55, 56 and 57 are slidingly sealed within the cylinders 50, 51, 52 and 53. The opposed pairs of pistons 54 and 55, and 56 and 57 are interconnected by rigid connecting rods 58 and 59 and the connecting rods 58 and 59 are interconnected by a rigid cross member 60.

A pair of rigidly interconnected plates 65 and 66 are disposed one on either side of the cylinders 50, 51, 52 and 53. The plates 65 and 66 are mounted on idler cranks 67, 68, 69 and 70, all of which are disposed in the same angular position relative to their axes of rotation. These idler cranks 67, 68, 69 and 70 constrain the plates 65 and 66 to move about an orbital path, the orbital path being parallel to the plane containing the axes of the connecting rods 58 and 59 and the cross member 60.

A pair of crank shafts 75 and 76 are rotatedly mounted in suitable bearings between plates 65 and 66, the axes 77 of the crank shafts 75 and 76 being disposed normal to the plates 65 and 66 at a position which as the plates 65 and 66 move about their orbital paths will describe a circular path 78 centred on the transverse axis 79 intermediate of opposed cylinders 50 and 51, and 52 and 53. The crank shafts 75 and 76 each have a crank pin 80 which is disposed between the plates 65 and 66 and a pair of crank pins 81 and 82, crank pin 81 being disposed on the outside of plate 65 and crank pin 82 being disposed on the outside of plate 66. Crank pin 80 is disposed diametrically of the crank pins 81 and 82 and the crank pins 80, 81, and 82 have a throw equal to the throw of the idler cranks 67, 68, 69 and 70. The angular relationship of the axes 77 to their circular paths 78 correspond to that of the idler cranks 67, 68, 69 and 70 with respect to their axes of rotation.

The crank pins 80 are pivotally connected in spaced relationship to the cross member 60 by means of a suitable bearing. The crank pins 81 and 82 are pivotally connected to weights 85 and 86 disposed on the outsides of plates 65 and 66 respectively, the weights 85 and 86 being located by guide means 87 by which they are constrained to move linearly.

An output shaft 90 is mounted in suitable bearings on an axis normal to the plane of movement of plate 65 and centrally thereof. The output shaft 90 passes through an elongate slot 91 in weight 85, the shaft being connected to the plate 65 by means of a crank 92 of equal throw and of the same angular relationship to the axis of shaft 90 as the idler cranks 67, 68, 69 and 70 are to their axes of rotation. In similar manner to that described with reference to the preceding embodiments, reciprocating movement of the pistons 50, 51, 52 and 53, will cause the crank shafts 75 and 76 to drive plates 65 and 66 about their orbital paths. This orbital motion of the plates 65 and 66 is transmitted to the output shaft 90 by means of crank 92, causing the output shaft 90 to rotate. The weights 85 and 86 move in linear reciprocating motion in a direction transverse to the direction of the pistons 50, 51, 52 and 53, the elongate hole 91 providing a clearance for the output shaft 90. The combined motion of pistons 50, 51, 52 and 53 and the weights 85 and 86 provide a rotary oscillation which may be balanced in similar manner to that described above.

In this embodiment, the bottom ends of cylinders 50, 51, 52 and 53 are sealed by partitions 95 so that upon downward movement of the pistons 54, 55, 56 and 57 gas which may be drawn in the cylinders below the pistons on the return strokes of the pistons 54, 55, 56 and 57 will be compressed and may be used for supercharging purposes. Inlet and outlet ports to the cylinders 50, 51, 52, and 53 on the underside of pistons 54, 55, 56 and 57 may be controlled by the reciprocating motion of the weights 85 and 86.

Valve means for cylinders 50, 51, 52 and 53, for example in the form of cylindrical valves of known configuration, may also be driven by the plates 55 and 56 in known manner.

Figure 6:
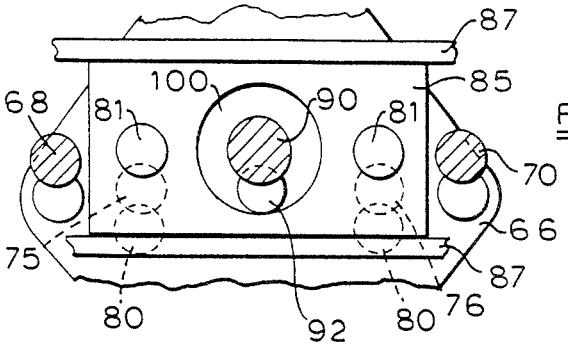
FIG. 6 shows the modification to the engine illustrated in FIGS. 4 and 5.

In the modification illustrated in FIG. 6, the output shaft 90 is cranked before the weight 85 and a circular aperture 100 is provided in the weight 85 to provide a clearance for the crank 101 as it is driven about a circular path while the weight 85 is driven along its linear reciprocating path.

Figure 7:
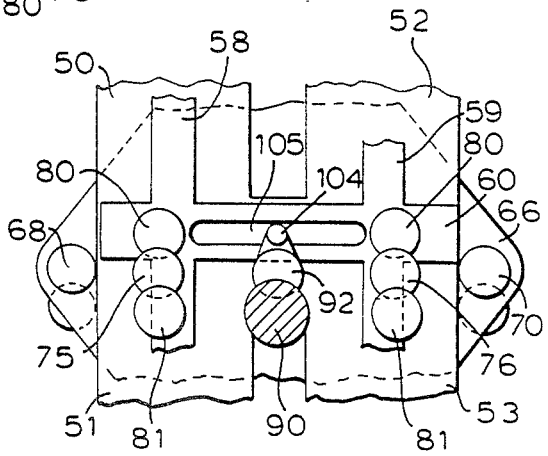
FIG. 7 shows an alternative modification to the engine illustrated in FIGS. 4 and 5.

As illustrated in FIG. 7, a pair of output shafts 90 may be provided one on each side of the plates 65 and 66, the shafts being interconnected by a pin 104 which extends through an elongate slot 105 in the cross member 60.

Figure 8:
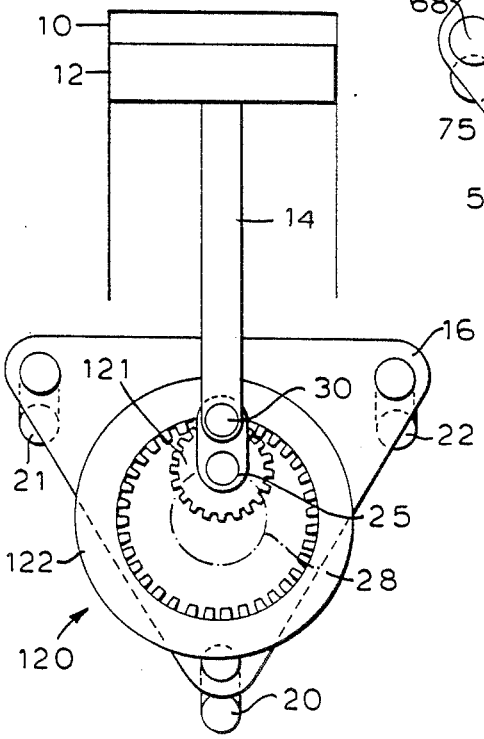
FIG. 8 shows a further modification to the engine illustrated in FIG. 1.

In the modification illustrated in FIG. 8 a hypocycloidal mechanism 120 acts upon the crank shaft 25 in order to constrain the first crank pin 30 to move in a linear path along the axis of cylinder 10. The hypocycloidal mechanism 120 comprises an external gear 121 which is mounted on crank shaft 25 for rotation therewith about axis 26. The gear 121 meshes with an internal gear 122 which is mounted in fixed relationship to the crank shaft 25 and link 16. The gears 121 and 122 are arranged such that as the link 16 moves about its orbital path the external gear 121 will remain in engagement with internal gear 122, the crank shaft being rotated so that crank pin 30 moves along its linear path. The hypocycloidal mechanism 121 may replace the second piston 13 so that a single cylindered engine may be provided. Alternatively, the hypocycloidal mechanism 120 may be used in multi-cylinder versions of the engine according to the present invention. This has the advantage of taking out side loads on the pistons or balance weights that are otherwise used to constrain the crank pins to move along linear paths.

I claim:

1. An internal combustion engine comprising a piston slidingly sealed and constrained to move along a linear path in a cylinder, the piston having a rigid connecting rod which extends axially of the cylinder, a link constrained to move in an orbital path in a plane parallel to the axis of the cylinder, the link being coupled to the connecting rod by means of a crank shaft rotatably mounted on the link, said crank shaft having a first crank pin which is pivotally connected to the connecting rod and means which will constrain said first crank pin to move in a linear path coaxial of the cylinder, so that linear motion of the piston will drive the link about its orbital path, an output shaft being coupled to the link so that orbital motion of the link will rotate the output shaft.

2. An internal combustion engine according to claim 1 in which the crank shaft has a second crank pin, said second crank pin being pivotally connected to means which will constrain said second crank pin to move in a linear path, the axis of said linear path being parallel to the plane of the orbital path of the link and transverse to the axis of the connecting rod so that the first crank pin will be constrained thereby to move in a linear path coaxially of the cylinder.

3. An internal combustion engine according to claim 2 in which the link comprises a pair of spaced plates, the plates being rigidly interconnected and being disposed on either side of the cylinder, the plane of movement of the plates being parallel to the axes of the connecting rod of the piston.

4. An internal combustion engine according to claim 3 in which the crank shaft is rotatably mounted, in suitable bearings, between the plates, the first crank pin being disposed between the plates.

5. An internal combustion engine according to claim 4 in which the second crank pin is disposed between the plates.

6. An internal combustion engine according to claim 4 in which the second and a third crank pin are disposed outside the plates, one on either side of the link.

7. An internal combustion engine according to claim 2 in which the means for constraining the second crank pin comprises a further piston and cylinder the axis of movement of the piston in the cylinder being transverse to that of the piston connected to the first crank pin.

8. An internal combustion engine according to claim 2 in which the second crank pin is constrained to move in a linear path by linear sliding guide means.

9. An internal combustion engine according to claim 8 in which the linear sliding guide means includes one or more linearly guided weights.

10. An internal combustion engine according to claim 2 in which the piston and means for guiding said second crank pin are arranged such that movement thereof will produce a resultant rotary oscillation.

11. An internal combustion engine according to claim 10 in which means is provided to balance the rotary oscillation.

12. An internal combustion engine according to claim 11 in which balance weights are associated with the output shaft.

13. An internal combustion engine according to claim 11 in which balance weights are associated with the link.

14. An internal combustion engine according to claim 1 in which the first crank pin is constrained to move in a linear path coaxially of the cylinder by means of a hypocycloidal gear mechanism.

15. An internal combustion engine according to claim 14 in which an external gear is mounted on the crank shaft for rotation therewith, the external gear meshing with a fixed internal gear so that upon orbital motion of the link the external gear will remain in engagement with the internal gear, the reaction between the gears causing the crank shaft to rotate, so that the first crank pin moves along its linear path.

16. An internal combustion engine according to claim 1 including at least one pair of axially opposed cylinders, pistons being slidably sealed in said cylinders, said pistons being interconnected by a rigid connecting rod.

17. An internal combustion engine according to claim 1 in which the or each cylinder is closed on the underside of the piston so that gas may be compressed therein on the downstroke of the piston, for supercharging purposes.

18. An internal combustion engine according to claim 1 in which the output shaft is coupled to the link by means of a crank, gear mechanism or pin drive.

19. An internal combustion engine according to claim 1 in which output shafts extend coaxially of one another from either side of the link.

20. An internal combustion engine according to claim 19 in which the output shafts are interconnected through the link.

21. An internal combustion engine according to claim 1 in which two pairs of axially opposed cylinders are disposed at right angles to one another, the axis of one pair of cylinders being spaced laterally of that of the other pair of cylinders, pistons slidably sealed in each cylinder of each pair of cylinders being interconnected by rigid connecting rods, a pair of interconnected plates being disposed one on either side of the cylinders for movement about an orbital path, the plane of the orbital path being parallel to the axes of the connecting rods, a crank shaft being rotatably mounted in suitable bearings across the plates, said crank shaft having a pair of diametrically opposed crank pins disposed between the plates, one crank pin being connected by suitable bearing means to one connecting rod and the other crank pin being connected by suitable bearing means to the other connecting rod.

22. An internal combustion engine according to claim 1 in which two pairs of axially opposed cylinders are disposed side by side, opposed pistons slidably sealed in said cylinders being interconnected by rigid connecting rods, the connecting rods being interconnected by a rigid crossmember, a pair of interconnected plates being disposed one on either side of the cylinders, said plates being mounted for movement about an orbital path, the plane of the orbital path being parallel to the axes of the connecting rods and crossmember, a pair of crank shafts being rotatably mounted in suitable bearings between the plates, said crank shafts having a first crank pin disposed between the plates and second and third crank pins, the second crank pin being disposed on the outside of one plate and the third crank pin being disposed on the outside of the other plate, the first crank pins being connected by means of suitable bearings to the crossmember and the second and third crank pins being connected by means of suitable bearings to weights disposed on the outsides of each of the plates, said weights being guided to move along a linear path transverse to the direction of movement of the pistons in the cylinders.

23. An internal combustion engine according to claim 22 in which the output shaft passes through an elongate slot in one of said weights, the output shaft being connected to one of the plates by means of a crank, the crank being disposed between the weight and the plate.

24. An internal combustion engine according to claim 22 in which the output shaft is coupled to the plate by means of a crank the output shaft being cranked before the weight, the crank passing through a circular aperture in the weight.

25. An internal combustion engine according to claim 22 in which output shafts are coupled to both plates coaxially of one another, the output shafts being coupled to the plates by means of cranks which are interconnected by a pin which passes through an elongate slot in the cross member.

* * * * *